US010127873B2

(12) United States Patent
Li

(10) Patent No.: US 10,127,873 B2
(45) Date of Patent: Nov. 13, 2018

(54) SLIM DISPLAY DEVICE

(71) Applicant: Chunghwa Picture Tubes, LTD., Taoyuan (TW)

(72) Inventor: Wei-Lung Li, Taoyuan (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 0 days.

(21) Appl. No.: 15/480,877

(22) Filed: Apr. 6, 2017

(65) Prior Publication Data

US 2018/0261176 A1 Sep. 13, 2018

(30) Foreign Application Priority Data

Mar. 9, 2017 (CN) ..... 2017 1 0136826

(51) Int. Cl.
*G09G 3/36* (2006.01)
*G09G 3/34* (2006.01)

(52) U.S. Cl.
CPC ..... *G09G 3/3659* (2013.01); *G09G 3/3453* (2013.01); *G09G 2300/0426* (2013.01); *G09G 2300/08* (2013.01); *G09G 2310/0218* (2013.01); *G09G 2310/0278* (2013.01); *G09G 2310/08* (2013.01)

(58) Field of Classification Search
CPC ..... G09G 3/3659; G09G 2310/0218; G09G 2310/0278
See application file for complete search history.

(56) References Cited

U.S. PATENT DOCUMENTS

2003/0169247 A1* 9/2003 Kawabe ..... G09G 3/342 345/204
2009/0079669 A1* 3/2009 Huang ..... G09G 3/3677 345/30
2011/0063260 A1* 3/2011 Wang ..... G09G 3/3677 345/204
2012/0154380 A1* 6/2012 Hwang ..... G02B 27/2264 345/419
2013/0235006 A1* 9/2013 Shin ..... G09G 3/003 345/204
2016/0086978 A1* 3/2016 French ..... H01L 27/3248 257/72

FOREIGN PATENT DOCUMENTS

TW I409531 9/2013

* cited by examiner

*Primary Examiner* — Yuzhen Shen
(74) *Attorney, Agent, or Firm* — J.C. Patents

(57) ABSTRACT

A display device including scan lines, data lines, k clock signal lines and pixel groups is provided. The pixel groups are respectively driven by the data lines, the corresponding scan lines and the corresponding clock signal lines. Each pixel group includes pixel units respectively configured at intersections of the data lines and the corresponding scan lines, where the scan lines in each pixel group receive a same scan driving signal. Each pixel unit includes two switches and a pixel electrode. Conduction states of the two switches are respectively controlled by the corresponding scan line and the corresponding clock signal line, where clock signals of the clock signal lines corresponding to the pixel units on the adjacent scan lines have a phase difference of 1/k cycle.

10 Claims, 10 Drawing Sheets

SLIM DISPLAY DEVICE

CROSS-REFERENCE TO RELATED APPLICATION

This application claims the priority benefit of China application serial no. 201710136826.4, filed on Mar. 9, 2017. The entirety of the above-mentioned patent application is hereby incorporated by reference herein and made a part of this specification.

BACKGROUND OF THE INVENTION

Field of the Invention

The invention relates to an electronic device, and particularly relates to a display device.

Description of Related Art

Along with development of display technology, displays have played an important role in our daily life. Presently, in order to meet the aesthetic needs, most of the displays are required to have a larger display area, and thus a development trend of slim border is formed.

Taking a liquid crystal display (LCD) panel as an example, the LCD panel is general composed of an active device array substrate, a counter substrate and a liquid crystal layer clamped between the active device array substrate and the counter substrate, where the active device array substrate can be divided into a display region and a non-display region, and a plurality of pixel units arranged in an array is configured in the display region, and each of the pixel units includes a thin-film transistor (TFT) and a pixel electrode connected to the TFT. Moreover, a plurality of scan lines and a plurality of data lines are configured in the display region, and the TFT of each pixel unit is electrically connected to the corresponding scan line and data line. Signal lines, source drivers and gate drivers are configured in the non-display region.

When the LCD panel displays an image frame, the gate driver has to be used to sequentially turn on the pixels of each row in the display panel, and the pixels of each row correspondingly receive a data voltage provided by the source driver within a turn-on period. In this way, liquid crystal molecules in the pixels of each row are properly arranged according to the received data voltage. However, along with increased of a resolution of the LCD panel, the signal lines, the gate drivers and the source drivers configured in the non-display region are correspondingly increased, such that an area of the non-display region (or referred to as a border) is enlarged. Moreover, the manufacturing cost of the LCD panel is also increased long with increased of a usage amount of the gate drivers and the source drivers.

SUMMARY OF THE INVENTION

The invention is directed to display device, in which a border area is effectively decreased, and a manufacturing cost of the display device is decreased.

An embodiment of the invention provides a display device including a plurality of scan lines, a plurality of data lines, k clock signal lines and a plurality of pixel groups, where k is an integer greater than 1. The pixel groups are respectively driven by the plurality of data lines, the plurality of corresponding scan lines and the plurality of corresponding clock signal lines. Each of the pixel groups includes a plurality of pixel units respectively configured at intersections of the plurality of data lines and the plurality of corresponding scan lines, where the plurality of scan lines in each pixel group receive a same scan driving signal. Each of the pixel units includes two switches and a pixel electrode. The pixel electrode is coupled to the data line corresponding to the pixel electrode through the two switches. A conduction state of one of the two switches is controlled by the corresponding scan line, and a conduction state of the other one of the two switches is controlled by the corresponding clock signal line, where clock signals of the clock signal lines corresponding to the pixel units on the adjacent scan lines have a phase difference of 1/k cycle, and the pixels units on the plurality of scan lines are sequentially driven.

In an embodiment of the invention, an nth pixel group of the plurality of pixel groups includes a first scan line, a plurality of first pixel units, a second scan line and a plurality of second pixel units. The first pixel units are configured at intersections of the plurality of data lines and the first scan line, and each of the first pixel units includes a first switch, a second switch and a first pixel electrode, where the first pixel electrode is coupled to the data line corresponding to the first pixel electrode through the first switch and the second switch, a conduction state of the second switch is controlled by the first scan line, and a conduction state of the first switch is controlled by an $(m-1)^{th}$ clock signal line of the k clock signal lines. The second scan line and the first scan line receive the same scan driving signal. The second pixel units are configured at intersections of the plurality of data lines and the second scan line, and each of the second pixel units includes a third switch, a fourth switch and a second pixel electrode, where the second pixel electrode is coupled to the data line corresponding to the second pixel electrode through the third switch and the fourth switch, a conduction state of the third switch is controlled by the second scan line, and a conduction state of the fourth switch is controlled by an $m^{th}$ clock signal line of the k clock signal lines, where m is smaller than or equal to k and, n is a positive integer.

In an embodiment of the invention, k is equal to 4.

In an embodiment of the invention, each of the pixel groups includes two scan lines.

In an embodiment of the invention, the two adjacent pixel groups respectively include a clock signal line driven by the same clock signal.

In an embodiment of the invention, each of the pixel groups includes four scan lines.

In an embodiment of the invention, k is equal to 2, and each of the pixel groups includes two scan lines.

In an embodiment of the invention, the first switch, the second switch, the third switch and the fourth switch are transistor switches.

In an embodiment of the invention, the two switches are transistor switches.

In an embodiment of the invention, the display device further includes a driving circuit, which is coupled to the plurality of scan lines, the plurality of data lines and the k clock signal lines, and drives the plurality of pixel groups through the plurality of scan lines, the plurality of data lines and the k clock signal lines, such that the pixel units on the scan lines of the display device are sequentially driven.

According to the above description, in the embodiment of the invention, the scan lines are used in collaboration with the clock signal lines to control the conduction state of the switches coupled to the data lines, so as to effectively decrease the number of output signal lines of the driving circuit, and reduce a circuit layer area, by which a slim border design of the display device is achieved, and the manufacturing cost of the display device is decreased.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
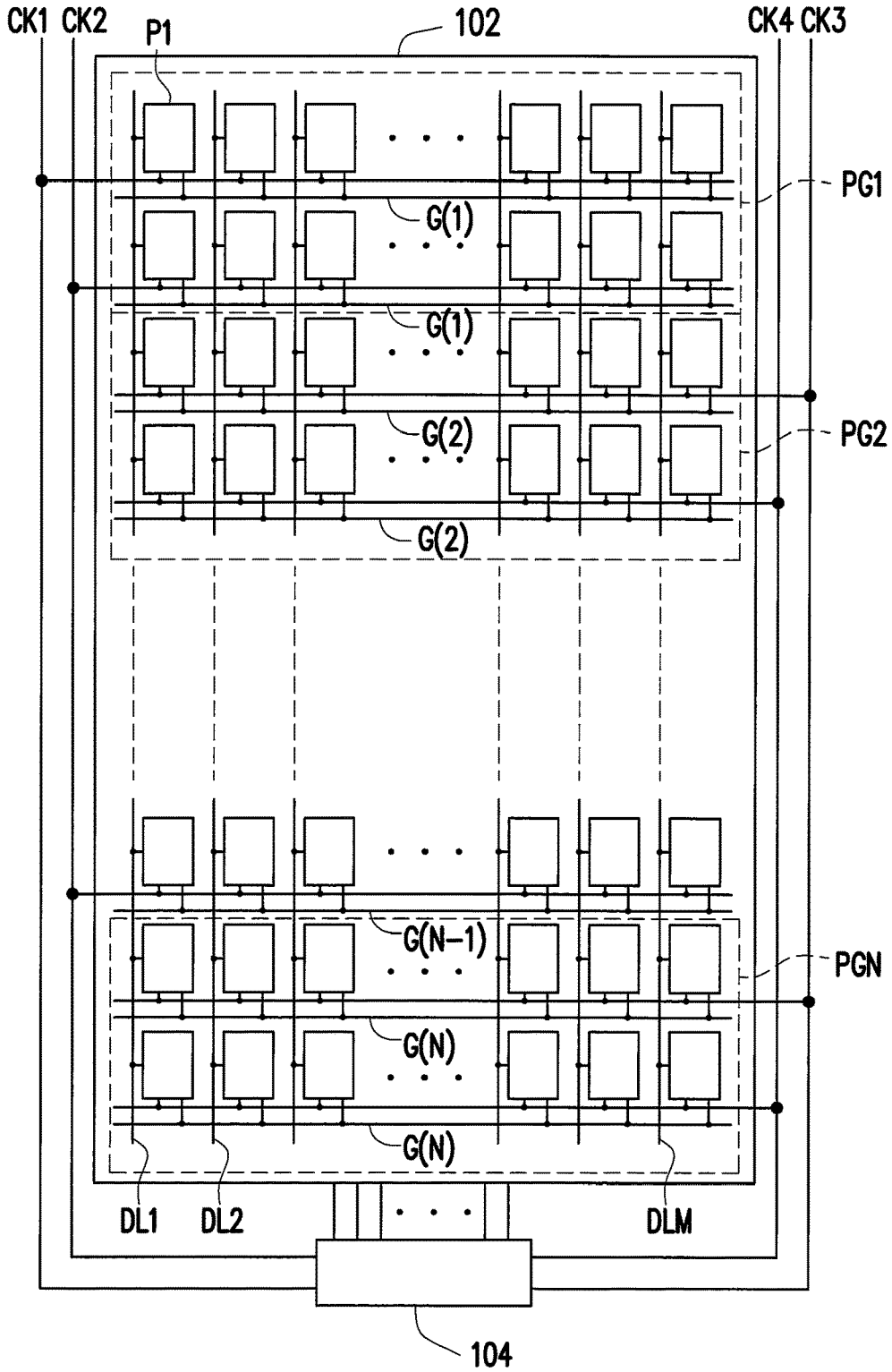
FIG. 1 is a schematic diagram of a display device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 13:
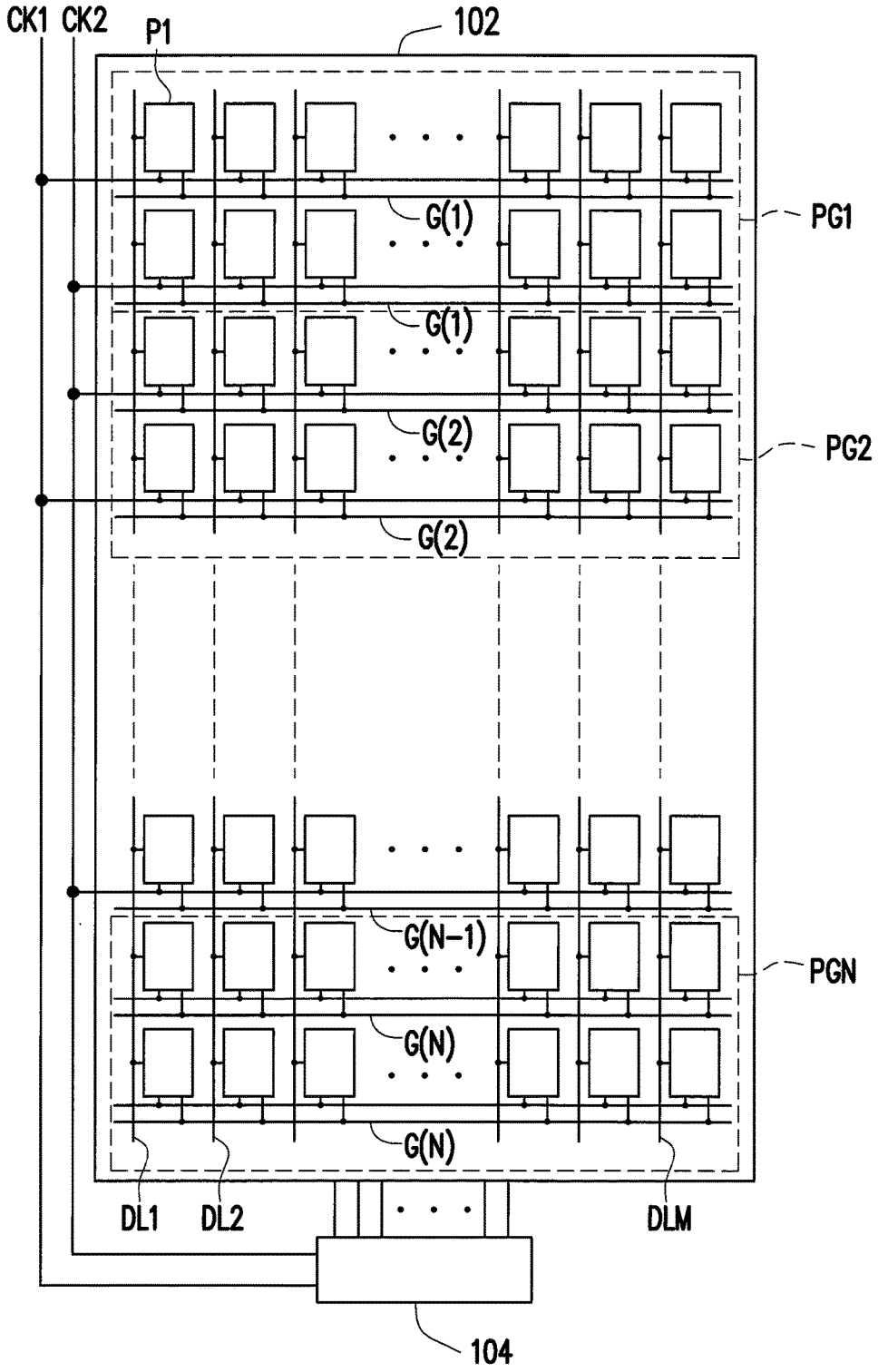
FIG. 13 is a schematic diagram of a display device according to another embodiment of the invention.

FIG. 1 is a schematic diagram of a display device according to an embodiment of the invention. Referring to FIG. 1, the display device is, for example, a liquid crystal display (LCD) device or an electronic paper display device, though the invention is not limited thereto. The display device includes an active device array substrate 102, a driving circuit 104 and a plurality of clock signal lines CK(k), where k is an integer greater than 1 (in the present embodiment, four clock signal lines CK1-CK4 are take as an example for description, i.e. k is equal to 4). The active device array substrate 102 includes a plurality of scan lines G(1), G(2), . . . , G(N), a plurality of data lines DL1-DLM, and a plurality of pixel groups PG1, PG2, . . . , PGN, where N, M are positive integers. The driving circuit 104 is coupled to the scan lines G(1)-G(N), the data lines DL1-DLM and the clock signal lines CK1-CK4 (for simplicity's sake, only the coupling relationship between the driving circuit 104 and the clock signal lines CK1-CK4 is directly illustrated in FIG. 1, and the coupling relationship between the driving circuit 104 and the scan lines G(1), G(2), . . . , G(N) and the data lines DL1-DLM is not illustrated, which is the same in following FIGS. 9, 10 and 13), and the driving circuit 104 drives the pixel groups PG1-PGN through the scan lines G(1)-G(N), the data lines DL1-DLM and the clock signal lines CK1-CK4, where each of the pixel groups is driven by the data lines DL1-DLM, the corresponding scan lines and the corresponding clock signal lines. For example, the pixel group PG1 is driven by the clock signal lines CK1-CK2, the data lines DL1-DLM and two scan lines G(1), and the pixel group PG2 is driven by the clock signal lines CK3-CK4, the data lines DL1-DLM and two scan lines G(2). Further, each of the pixel groups may respectively include a plurality of pixel units P1, and the pixel units P1 can be respectively configured at intersections of the corresponding scan lines and data lines. In FIG. 1, the scan lines with the same device referential number (for example, the aforementioned two scan lines G(1)) can be coupled to a same signal output pin of the driving circuit 104, and are driven by a scan driving signal output by the same signal output pin. Namely, the scan lines in each pixel group receive the same scan driving signal. By driving the scan lines, the data lines and the clock signal lines, the pixel units connected to the scan lines of the display device can be sequentially driven to display an image frame.

Figure 2:
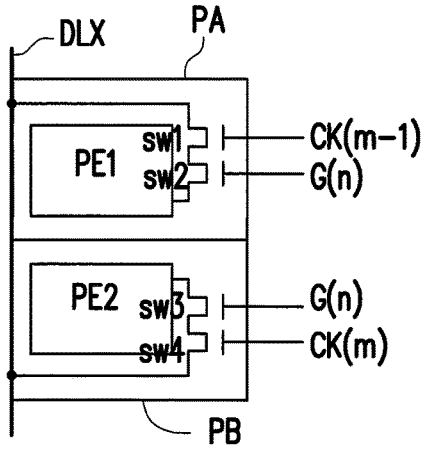
FIG. 2 is a schematic diagram of a pixel circuit according to an embodiment of the invention.

Further, each of the pixel units P1 may include two switches and a pixel electrode. For example, FIG. 2 is a schematic diagram of a pixel circuit according to an embodiment of the invention. Referring to FIG. 2, in the embodiment of FIG. 2, two pixel units PA and PB on a same data line in the same pixel group and corresponding to two adjacent scan lines G(n) are taken as an example to describe the pixel circuit (it is assumed that the pixel units PA and PB of the present embodiment belong to an nth pixel group). As shown in FIG. 2, the pixel unit PA includes a pixel electrode PE1, a switch SW1 and a switch SW2. The pixel electrode PE1 can be coupled to a data line DLX corresponding to the pixel electrode PE1 through the switch SW1 and the switch SW2. Similarly, the pixel unit PB includes a pixel electrode PE2, a switch SW3 and a switch SW4. The pixel electrode PE2 can be coupled to the data line DLX corresponding to the pixel electrode PE2 through the switch SW3 and the switch SW4. In view of different pixel units, the data line DLX can be one of the data lines DL1-DLM. The switches SW1, SW2 are, for example, implemented by transistor switches, though the invention is not limited thereto. The switch SW3 and the switch SW2 can be controlled by the corresponding scan line G(n), and the switch SW1 and the switch SW4 are respectively controlled by the corresponding $(m-1)^{th}$ clock signal line CK(m−1) of the k clock signal lines and the $m^{th}$ clock signal line CK(m) of the k clock signal lines, where m is smaller than or equal to k and, n is a positive integer. Moreover, the clock signals of the clock signal lines CK(m−1) and CK(m) have a phase difference of 1/k cycle. For example, in the present embodiment, k is equal to 4, and the clock signals of the clock signal lines CK(m−1) and CK(m) have a phase difference of ¼ cycle.

Figure 3:
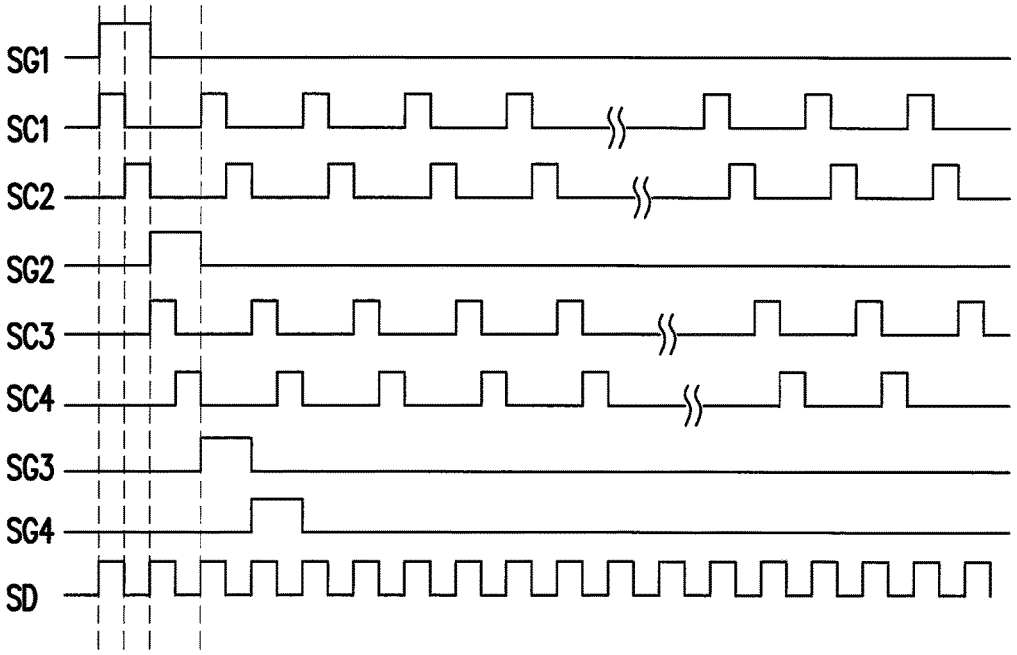
FIG. 3 is a waveform schematic diagram of scan signals, data signals and clock signals according to an embodiment of the invention.

The driving circuit 104 may respectively output scan signals SG1-SGN, data signals SD1-SDM and clock signals SC1-SC4 through the scan lines G(1)-G(N), the data lines DL1-DLM and the clock signal lines CK1-CK4 to drive the pixel groups PG1-PGN. For example, FIG. 3 is a waveform schematic diagram of the scan signals, the data signals and the clock signals according to an embodiment of the invention. Referring to FIG. 2 and FIG. 3, for simplicity's sake, in the embodiment of FIG. 3, only the scan signals SG1-SG4 on the scan lines G(1)-G(4), the data signal SD on the data line DLX and the clock signals SC1-SC4 on the clock signal lines CK1-CK4 are taken as an example for description. As shown in FIG. 3, the clock signals of two adjacent clock signal lines have a phase difference of ¼ cycle. For example, an interval between two rising edges of the clock signal SC1 can be divided into four equal parts, and a phase delay time of the clock signal SC2 relative to the clock signal SC1 is ¼ of the above interval. Therefore, the clock signal SC1 and the clock signal SC2 have a phase difference of ¼ cycle. When the scan signal SG1 and the clock signal SC1 have a high voltage level, the pixel electrode PE1 of the pixel unit PA in the pixel group PG1 may receive the data signal SD from the data line DLX through the switches SW1 and SW2, and when the clock signal SC2 and the scan signal SG1 have the high voltage level, the pixel electrode PE2 of the pixel unit PB in the pixel group PG1 may receive the data signal SD from the data line DLX through the switches SW3 and SW4 (now n=1, m=2). When the scan signal SG2 and the clock signal SC3 have the high voltage level, the pixel electrode PE1 of the pixel unit PA in the pixel group PG2 may receive the data signal SD from the data line DLX through the switches SW1 and SW2, and when the clock signal SC4 and the scan signal SG2 have the high voltage level, the pixel electrode PE2 of the pixel unit PB in the pixel group PG2 may receive the data signal SD from the data line DLX through the switches SW3 and SW4 (now n=2, m=4). Deduced by analogy, the switches corresponding to the pixel units PA and PB in the pixel groups PG3-PG4 can be controlled by the corresponding scan signals and clock signals to change conduction states thereof, such that the pixel units corresponding to the scan lines in the pixel groups PG3-PG4 may sequentially receive the data signal SD, so as to display an image frame of the corresponding data signal SD.

In this way, by using the scan lines in collaboration with the clock signal lines to control the conduction states of the switches coupled to the data lines, only four clock signal lines are added without adding the scan line, and the number of the scan lines can be decreased to a half, so as to effectively decrease the output signal lines of the driving circuit (which is, for example, implemented by a chip), and decrease a circuit layout area, which avails achieving the slim border design of the display device and decreasing the manufacturing cost of the display device. Taking a resolution of 800×1440 as an example, by applying the structure of the present embodiment, the output signal lines of the driving circuit 104 may only include 400 scan lines, 1440 data lines and 4 clock signal lines, by which (800+1440)−(400+1440+4)=396 output signal lines are saved.

Figure 4:
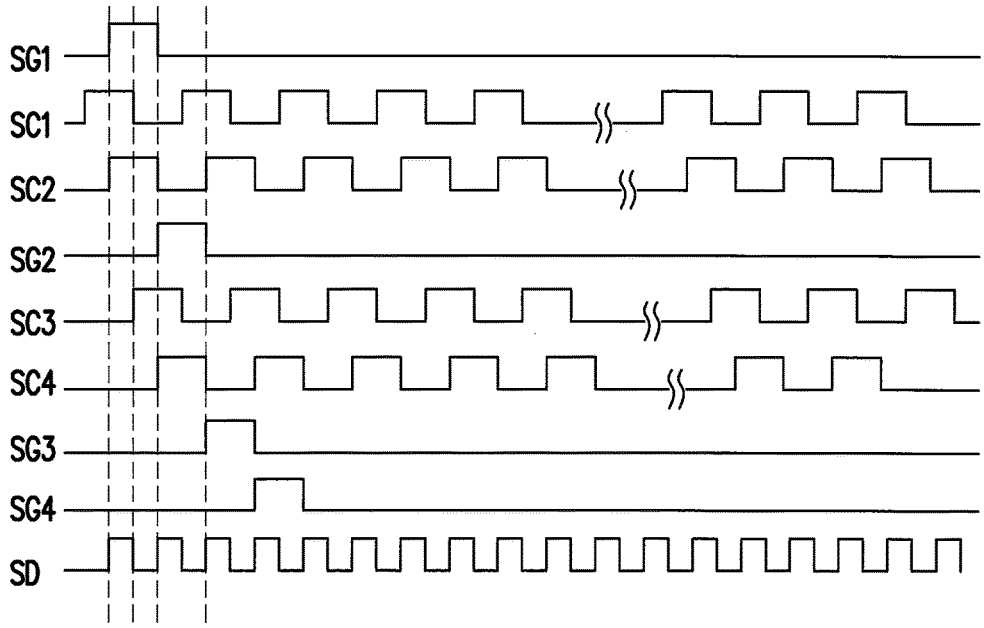
FIG. 4 is a waveform schematic diagram of scan signals, data signal and clock signals according to another embodiment of the invention.

It should be noted that in some embodiments, the clock signals SC1-SC4 of the embodiment of FIG. 3 may have a larger duty cycle. FIG. 4 is a waveform schematic diagram of the scan signals, the data signal and the clock signals according to another embodiment of the invention. In the embodiment of FIG. 4, the duty cycle of the clock signals SC1-SC4 is increased to 50%, and the clock signals of the adjacent scan lines still have the phase difference of ¼ cycle, and the waveforms of the scan signals and the data signal are the same with that of the embodiment of FIG. 3. Since the method of using the signals of the embodiment of FIG. 4 to control and drive the pixel circuit is the same to the method of using the signals of the embodiment of FIG. 3 to control and drive the pixel circuit, detail thereof is not repeated.

Figure 5:
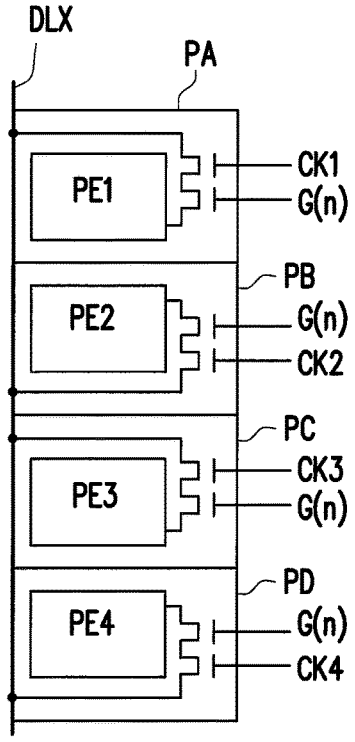
FIG. 5 is a schematic diagram of a pixel circuit according to another embodiment of the invention.

Moreover, in order to further decrease the number of the scan lines, the duty cycle of the scan signals is required to be increased. For example, FIG. 5 is a schematic diagram of a pixel circuit according to another embodiment of the invention. Referring to FIG. 5, a difference between the pixel circuit of the present embodiment and the pixel circuit of the embodiment of FIG. 2 is that in the present embodiment, one pixel group PGn may include 4 scan lines G(n), so as to further decrease the number of the output signal lines of the driving circuit. In the present embodiment, four pixel units PA-PD on a same data line in the same pixel group and corresponding to 4 scan lines G(n) are taken as an example to describe the pixel circuit. As shown in FIG. 5, the pixel units PA-PD respectively include a pixel electrode (PE1-PE4) and two switches, where one of the two switches corresponding to each of the pixel units is coupled to the scan line G(n), and the other switch is coupled to the corresponding clock signal line (CK1-CK4). The pixel electrodes PE1-PE4 can be respectively coupled to the corresponding data line DLX through the corresponding two switches, and in view of different pixel units, the data line DLX can be one of the data lines DL1-DLM.

Figure 6:
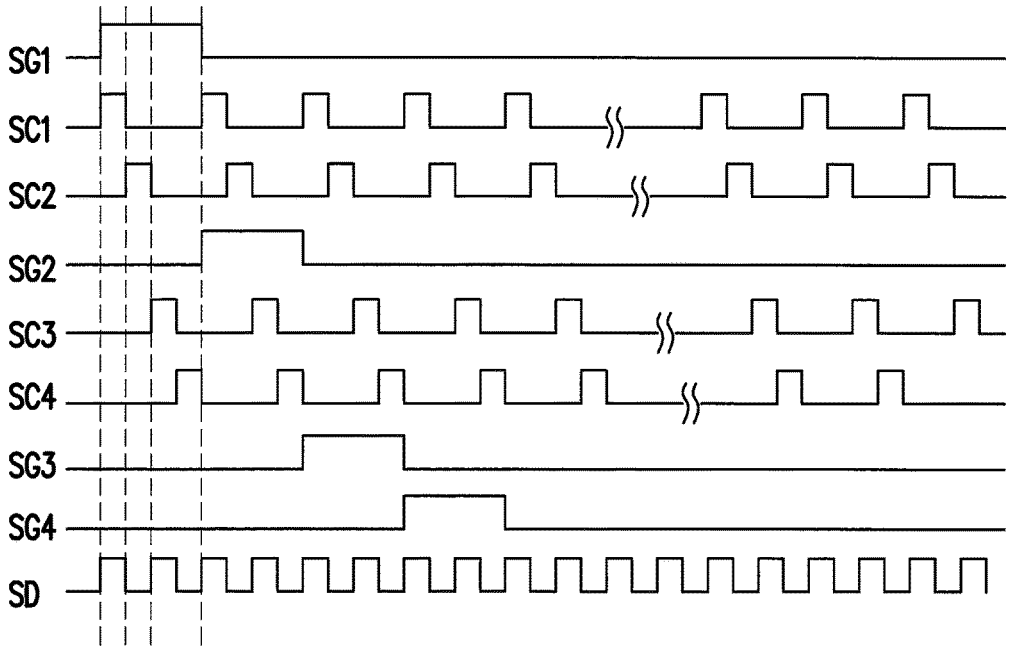
FIG. 6 is a waveform schematic diagram of scan signals, data signal and clock signals according to another embodiment of the invention.

FIG. 6 is a waveform schematic diagram of the scan signals, the data signal and the clock signals according to another embodiment of the invention. Referring to FIG. 5 and FIG. 6, in the embodiment of FIG. 6, only the scan signals SG1-SG4 on the scan lines G(1)-G(4), the data signal SD on the data line DLX and the clock signals SC1-SC4 on the clock signal lines CK1-CK4 are taken as an example for description. As shown in FIG. 6, the clock signals of the adjacent clock signal lines have the phase difference of ¼ cycle. Moreover, since the number of the scan lines G(n) included in the pixel group PGn is increased, a time for the scan signals SG1-SG4 of the embodiment of FIG. 6 being in the high voltage level is twice compared to that of the embodiment of FIG. 3, i.e. the duty cycle of the scan signals SG1-SG4 is increased. When the scan signal SG1 and the clock signal SC1 have the high voltage level, the pixel electrode PE1 of the pixel unit PA in the pixel group PG1 may receive the data signal SD from the data line DLX through the corresponding two switches; when the scan signal SG1 and the clock signal SC2 have the high voltage level, the pixel electrode PE2 of the pixel unit PB in the pixel group PG1 may receive the data signal SD from the data line DLX through the corresponding two switches; when the scan signal SG1 and the clock signal SC3 have the high voltage level, the pixel electrode PE3 of the pixel unit PC in the pixel group PG1 may receive the data signal SD from the data line DLX through the corresponding two switches; and when the scan signal SG1 and the clock signal SC4 have the high voltage level, the pixel electrode PE4 of the pixel unit PD in the pixel group PG1 may receive the data signal SD from the data line DLX through the corresponding two switches. Deduced by analogy, the switches corresponding to the pixel units PA-PD in the pixel groups PG3-PG4 can be controlled by the corresponding scan signals and clock signals to change conduction states thereof, such that the pixel units corresponding to the scan lines in the pixel groups PG3-PG4 may sequentially receive the data signal SD, so as to display an image frame of the corresponding data signal SD. Similarly, the present embodiment may also achieve the effects of effectively decreasing the output signal lines of the driving circuit, decreasing the circuit layout area, and decreasing the manufacturing cost of the display device.

Taking the resolution of 800×1440 as an example, by applying the structure of the present embodiment, the effect of saving (800+1440)−(200+1440+4)=596 output signal lines is also achieved.

Figure 7:
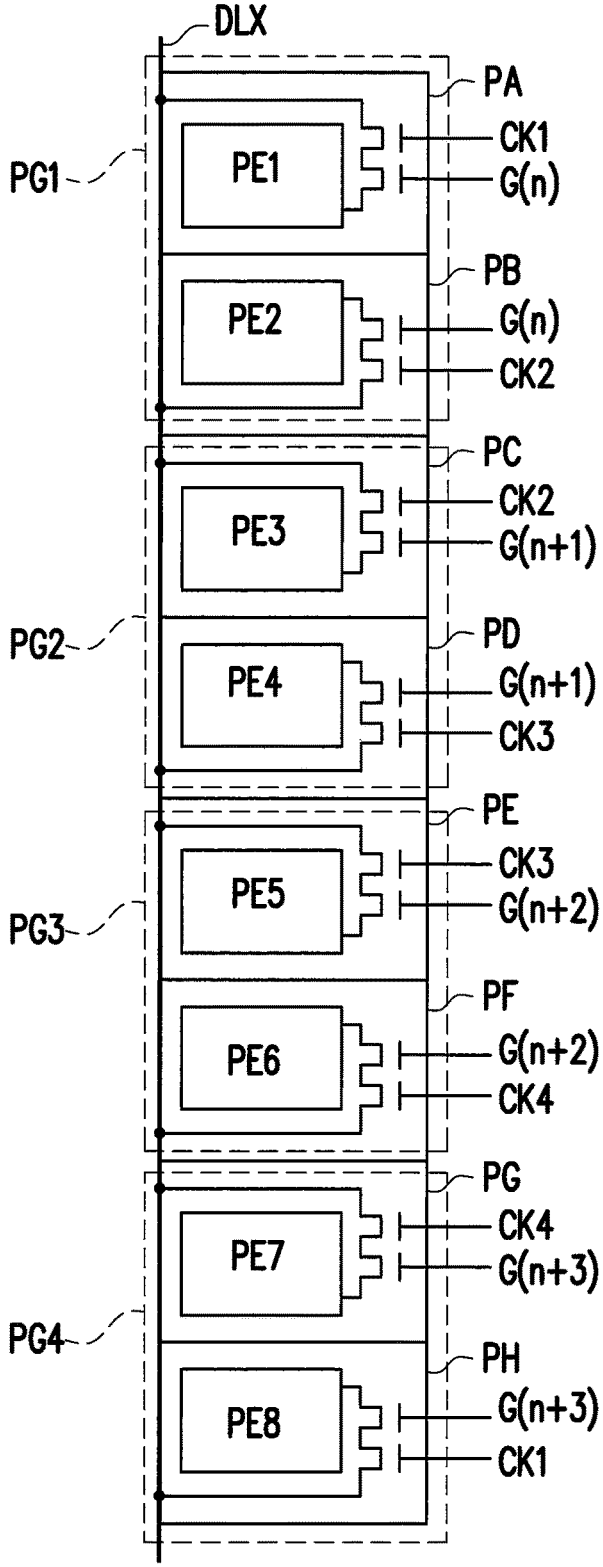
FIG. 7 is a schematic diagram of a pixel circuit according to another embodiment of the invention.

FIG. 7 is a schematic diagram of a pixel circuit according to another embodiment of the invention. Referring to FIG. 7, a difference between the present embodiment and the embodiment of FIG. 2 is that in the present embodiment, the two adjacent pixel groups respectively include one clock signal line driven by the same clock signal. For example, in FIG. 7, the pixel units PA and PB belong to a same pixel group PG1 to share a scan line G(n), the pixel units PC and PD belong to a same pixel group PG2 to share a scan line G(n+1), the pixel units PE and PF belong to a same pixel group PG3 to share a scan line G(n+2), and the pixel units PG and PH belong to a same pixel group PG4 to share a scan line G(n+3), where the pixel group PG1 and the pixel group PG2 share the clock signal line CK2, the pixel group PG2 and the pixel group PG3 share the clock signal line CK3, and the pixel group PG3 and the pixel group PG4 share the clock signal line CK4. In this way, the 4 clock signal lines CK1-CK4 are used to drive the pixel units PA-PH in a recursive way, so as to decrease the number of the output signal lines of the driving circuit 104.

Figure 8:
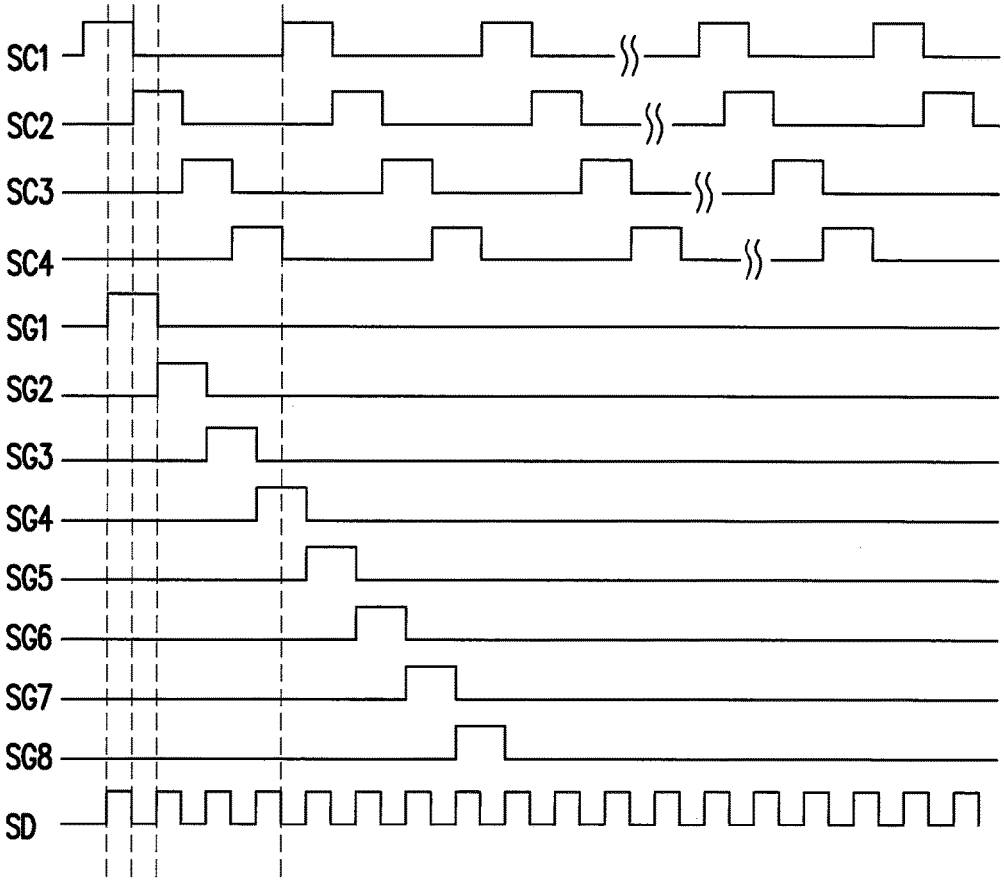
FIG. 8 is a waveform schematic diagram of scan signals, data signal and clock signals according to another embodiment of the invention.

Further, the pixel circuit of FIG. 7 can be driven by the scan signals, the data signal and the clock signals shown in FIG. 8. Referring to FIG. 7 and FIG. 8, in the embodiment of FIG. 8, only the scan signals SG1-SG8 on the scan lines G(1)-G(8), the data signal SD on the data line DLX and the clock signals SC1-SC4 on the clock signal lines CK1-CK4 are taken as an example for description. As shown in FIG. 8, when the scan signal SG1 and the clock signal SC1 have the high voltage level, the pixel electrode PE1 of the pixel unit PA in the pixel group PG1 may receive the data signal SD from the data line DLX through the corresponding two switches; when the scan signal SG1 and the clock signal SC2 have the high voltage level, the pixel electrode PE2 of the pixel unit PB in the pixel group PG1 may receive the data signal SD from the data line DLX through the corresponding two switches; when the scan signal SG2 and the clock signal SC2 have the high voltage level, the pixel electrode PE3 of the pixel unit PC in the pixel group PG2 may receive the data signal SD from the data line DLX through the corresponding two switches; when the scan signal SG2 and the clock signal SC3 have the high voltage level, the pixel electrode PE4 of the pixel unit PD in the pixel group PG2 may receive the data signal SD from the data line DLX through the corresponding two switches; when the scan signal SG3 and the clock signal SC3 have the high voltage level, the pixel electrode PE5 of the pixel unit PE in the pixel group PG1 may receive the data signal SD from the data line DLX through the corresponding two switches; when the scan signal SG3 and the clock signal SC4 have the high voltage level, the pixel electrode PE6 of the pixel unit PF in the pixel group PG3 may receive the data signal SD from the data line DLX through the corresponding two switches; when the scan signal SG4 and the clock signal SC4 have the high voltage level, the pixel electrode PE7 of the pixel unit PG in the pixel group PG4 may receive the data signal SD from the data line DLX through the corresponding two switches; when the scan signal SG4 and the clock signal SC1 have the high voltage level, the pixel electrode PE8 of the pixel unit PD in the pixel group PG4 may receive the data signal SD from the data line DLX through the corresponding two switches. Deduced by analogy, the switches corresponding to the pixel units in the pixel groups PG5-PG8 can be controlled by the corresponding scan signals and clock signals to change conduction states thereof, such that the pixel units corresponding to the scan lines in the pixel groups PG5-PG8 may sequentially receive the data signal SD, so as to display an image frame of the corresponding data signal SD. Similarly, the present embodiment may also achieve the effects of effectively decreasing the output signal lines of the driving circuit, decreasing the circuit layout area, and decreasing the manufacturing cost of the display device. Taking the resolution of 800×1440 as an example, by applying the structure of the present embodiment, the effect of saving (800+1440)−(400+1440+4)=396 output signal lines is also achieved.

Figure 9:
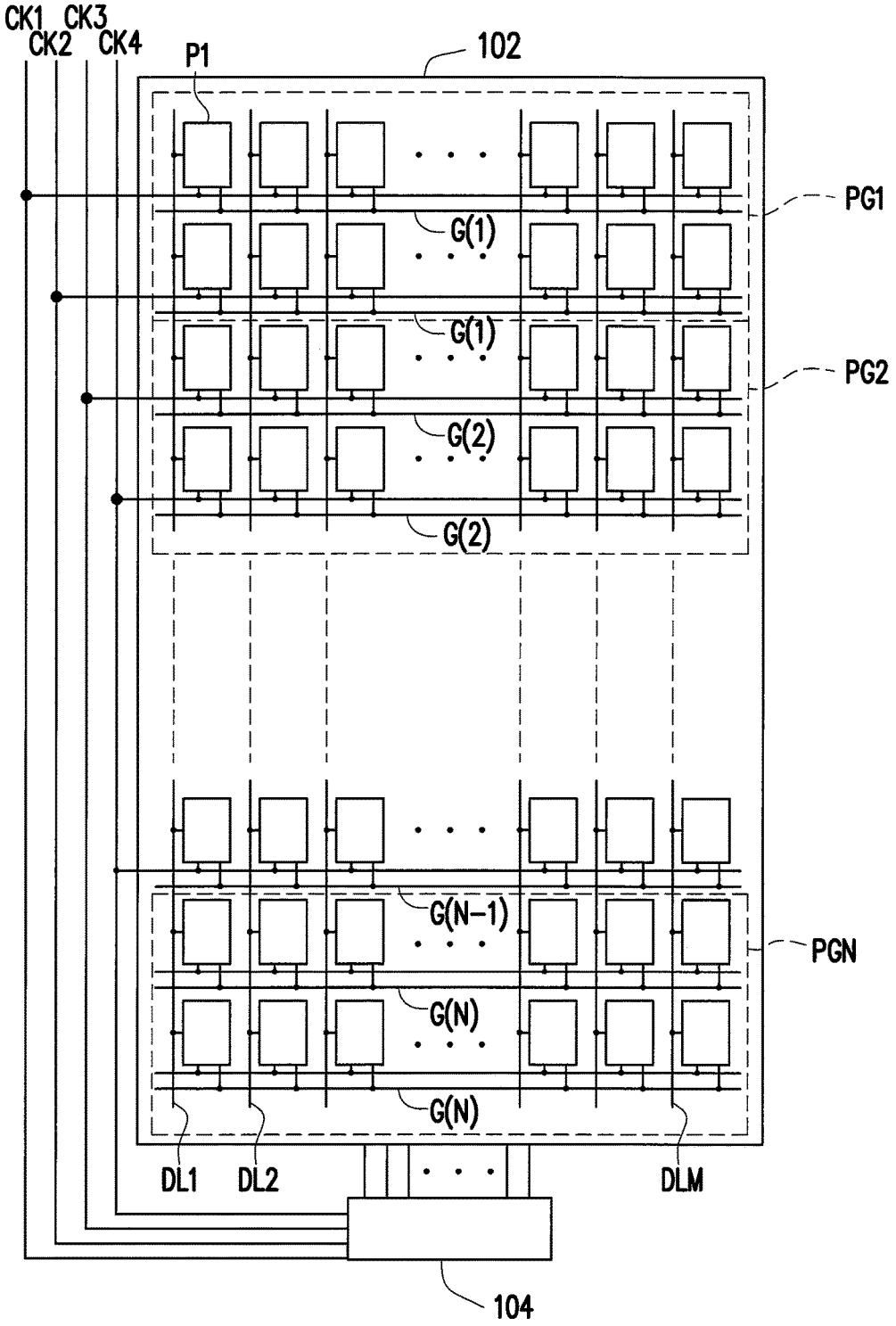
FIG. 9 is a schematic diagram of a display device according to another embodiment of the invention.
Figure 10:
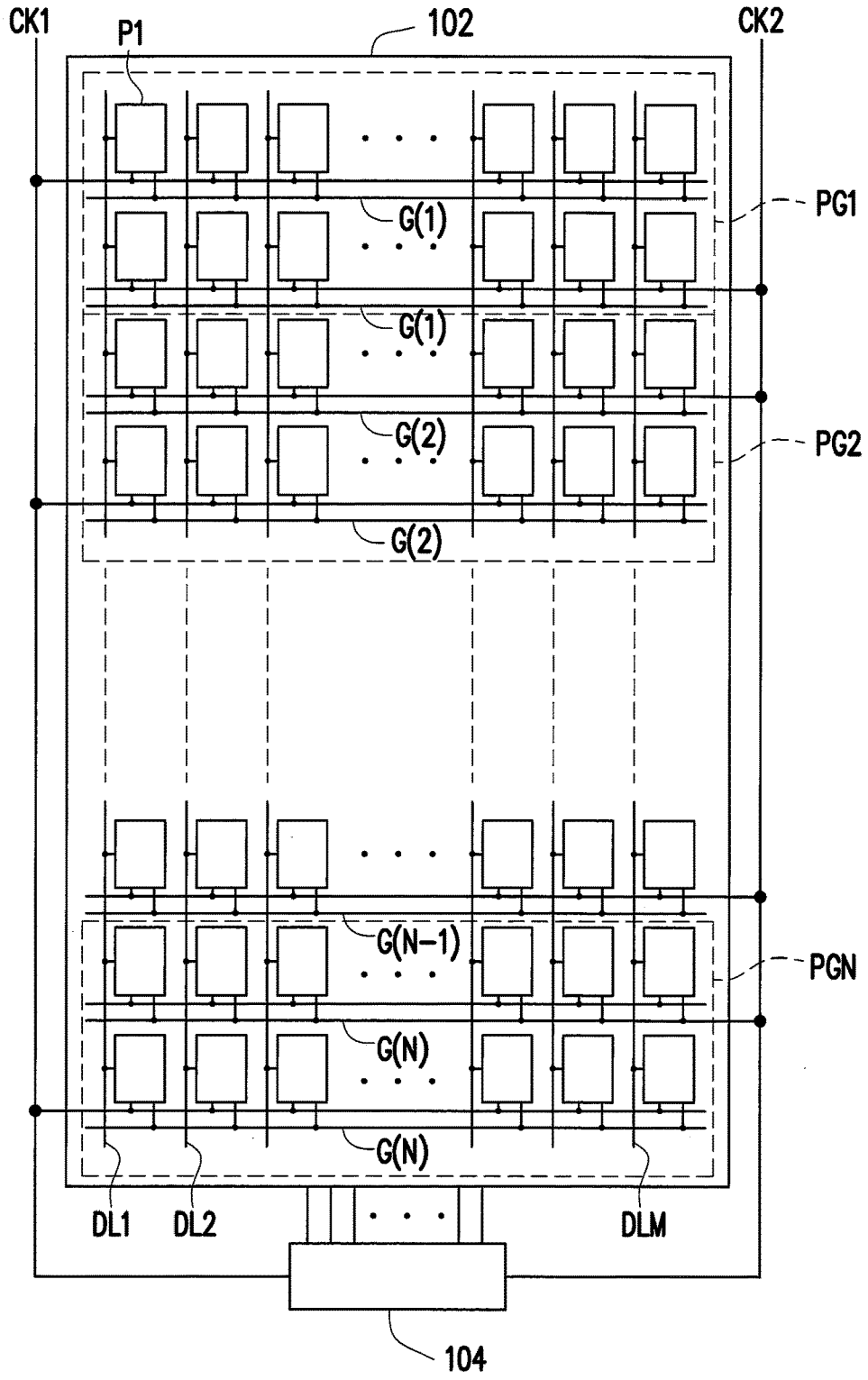
FIG. 10 is a schematic diagram of a display device according to another embodiment of the invention.

It should be noted that in some embodiments, the clock signal lines CK1-CK4 can also be disposed at a same side of the active device array substrate 102 as that shown in the embodiment of FIG. 9 without being equally disposed at two sides of the active device array substrate 102 as that shown in the embodiment of FIG. 1. Moreover, although 4 clock signal lines CK1-CK4 are adopted for description in all of the aforementioned embodiments, the number of the clock signal lines is not limited thereto in actual applications, and in other embodiments, the number of the clock signal lines can be can be any value greater than or equal to 2. For example, FIG. 10 is a schematic diagram of a display device according to another embodiment of the invention, and in the embodiment of FIG. 10, the display device only includes 2 clock signal lines CK1, CK2, and the number of the output signal lines of the driving circuit can also be decreased according to a method similar to the method of the aforementioned embodiment.

Figure 11:
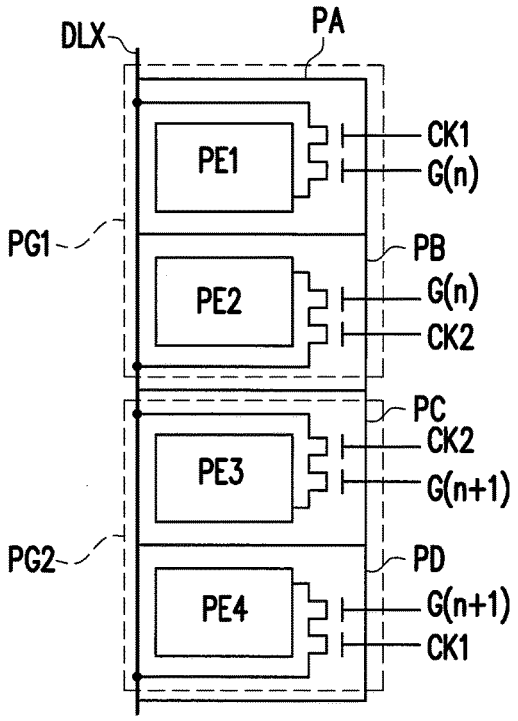
FIG. 11 is a schematic diagram of a pixel circuit according another embodiment of the invention.
Figure 12:
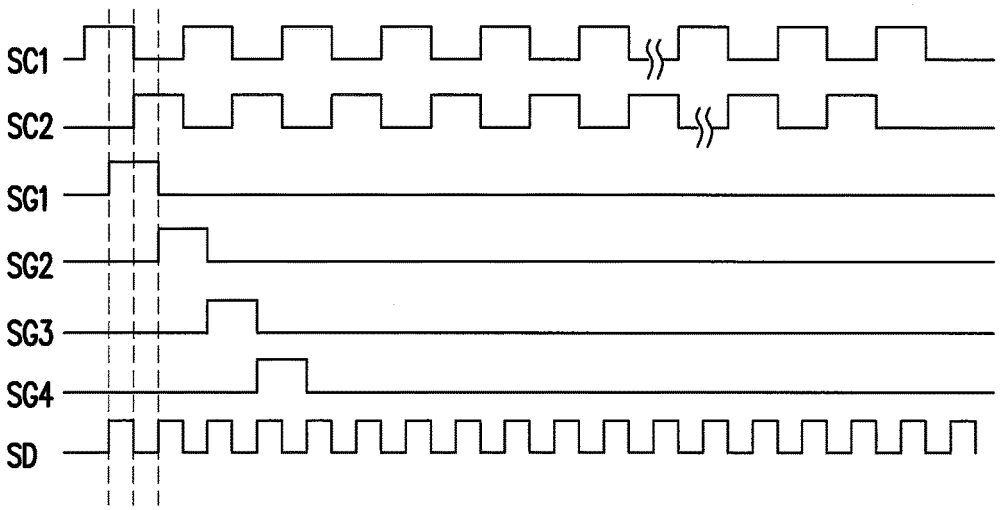
FIG. 12 is a waveform schematic diagram of scan signals, data signal and clock signals according to another embodiment of the invention.

For example, FIG. 11 is a schematic diagram of a pixel circuit according another embodiment of the invention, in FIG. 11, the pixel units PA and PB belong to a same pixel group PG1, and the pixel units PC and PD belong to a same pixel group PG2, and similar to the embodiment of FIG. 7, the 2 clock signal lines CK1, CK2 are used to drive the pixel units PA-PD in the recursive way, so as to decrease the number of the output signal lines of the driving circuit 104. Further, the pixel circuit of FIG. 11 can be driven by the scan signals, the data signal and the clock signals shown in FIG. 12. Referring to FIG. 11 and FIG. 12, in the embodiment of FIG. 12, only the scan signals SG1-SG4 on the scan lines G(1)-G(4), the data signal SD on the data line DLX and the clock signals SC1, SC2 on the clock signal lines CK1, CK2 are taken as an example for description. As shown in FIG. 12, when the scan signal SG1 and the clock signal SC1 have the high voltage level, the pixel electrode PE1 of the pixel unit PA in the pixel group PG1 may receive the data signal SD from the data line DLX through the corresponding two switches; when the scan signal SG1 and the clock signal SC2 have the high voltage level, the pixel electrode PE2 of the pixel unit PB in the pixel group PG1 may receive the data signal SD from the data line DLX through the corresponding two switches; when the scan signal SG2 and the clock signal SC2 have the high voltage level, the pixel electrode PE3 of the pixel unit PC in the pixel group PG2 may receive the data signal SD from the data line DLX through the corresponding two switches; when the scan signal SG2 and the clock signal SC1 have the high voltage level, the pixel electrode PE4 of the pixel unit PD in the pixel group PG2 may receive the data signal SD from the data line DLX through the corresponding two switches. Deduced by analogy, the switches corresponding to the pixel units in the pixel groups PG3-PG4 can be controlled by the corresponding scan signals and clock signals to change conduction states thereof, such that the pixel units corresponding to the scan lines in the pixel groups PG3-PG4 may sequentially receive the data signal SD, so as to display an image frame of the corresponding data signal SD. Similarly, the present embodiment may also achieve the effects of effectively decreasing the output signal lines of the driving circuit, decreasing the circuit layout area, and decreasing the manufacturing cost of the display device. Taking the resolution of 800×1440 as an example, by applying the structure of the present embodiment, the effect of saving (800+1440)−(400+1440+2)=398 output signal lines is also achieved. Moreover, in some embodiments, the clock signal lines CK1, CK2 can also be disposed at a same side of the active device array substrate 102 as that shown in the embodiment of FIG. 13 without being equally disposed at the two sides of the active device array substrate 102 as that shown in the embodiment of FIG. 11.

In summary, in the embodiment of the invention, the scan lines are used in collaboration with the clock signal lines to control the conduction state of the switches coupled to the data lines, so as to effectively decrease the number of the output signal lines of the driving circuit, and reduce a circuit layer area, by which a slim border design of the display device is achieved, and the manufacturing cost of the display device is decreased.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display device, comprising:

a plurality of scan lines;

a plurality of data lines;

k clock signal lines, wherein k is an integer greater than 1 and smaller than or equal to 4; and a plurality of pixel groups, respectively driven by the plurality of data lines, a plurality of corresponding scan lines and a plurality of corresponding clock signal lines, wherein each of the k clock signal lines is coupled to different pixel groups, and each of the pixel groups comprising:

a plurality of pixel units, respectively configured at intersections of the plurality of data lines and the plurality of corresponding scan lines, wherein the plurality of scan lines in each pixel group receive a same scan driving signal, and each of the pixel units comprises:

two switches; and a pixel electrode, coupled to a data line corresponding to the pixel electrode through the two switches, a conduction state of one of the two switches being controlled by a corresponding scan line, and a conduction state of the other one of the two switches being controlled by a corresponding clock signal line, wherein clock signals of the clock signal lines corresponding to the pixel units on the adjacent scan lines have a phase difference of 1/k cycle, and the pixels units on the plurality of scan lines are sequentially driven.

2. The display device as claimed in claim 1, wherein an $n^{th}$ pixel group in the plurality of pixel groups comprises:

a first scan line;

a plurality of first pixel units, configured at intersections of the plurality of data lines and the first scan line, and each of the first pixel units comprising:

a first switch, a second switch; and a first pixel electrode, coupled to the data line corresponding to the first pixel electrode through the first switch and the second switch, a conduction state of the second switch being controlled by the first scan line, and a conduction state of the first switch being controlled by an $(m-1)^{th}$ clock signal line of the k clock signal lines;

a second scan line, receiving the same scan driving signal together with the first scan line; and a plurality of second pixel units, configured at intersections of the plurality of data lines and the second scan line, and each of the second pixel units comprising:

a third switch;

a fourth switch; and a second pixel electrode, coupled to the data line corresponding to the second pixel electrode through the third switch and the fourth switch, a conduction state of the third switch being controlled by the second scan line, and a conduction state of the fourth switch being controlled by an $m^{th}$ clock signal line of the k clock signal lines, wherein m is smaller than or equal to k and n is a positive integer.

3. The display device as claimed in claim 2, wherein k is equal to 4.

4. The display device as claimed in claim 3, wherein each of the pixel groups comprises two scan lines.

5. The display device as claimed in claim 4, wherein the two adjacent pixel groups respectively comprise a clock signal line driven by the same clock signal.

6. The display device as claimed in claim 3, wherein each of the pixel groups comprises four scan lines.

7. The display device as claimed in claim 2, wherein k is equal to 2, and each of the pixel groups comprises two scan lines.

8. The display device as claimed in claim 2, wherein the first switch, the second switch, the third switch and the fourth switch are transistor switches.

9. The display device as claimed in claim 1, wherein the two switches are transistor switches.

10. The display device as claimed in claim 1, further comprising:

a driving circuit, coupled to the plurality of scan lines, the plurality of data lines and the k clock signal lines, and driving the plurality of pixel groups through the plurality of scan lines, the plurality of data lines and the k clock signal lines, such that the pixel units on the scan lines of the display device are sequentially driven.

* * * * *